United States Patent [19]

Kuhn

[11] 4,345,722

[45] Aug. 24, 1982

[54] DOUBLE-DRUM WINDER

[75] Inventor: Friedrich Kuhn, Heidenheim, Fed. Rep. of Germany

[73] Assignee: J. M. Voith GmbH, Fed. Rep. of Germany

[21] Appl. No.: 172,423

[22] Filed: Jul. 25, 1980

[30] Foreign Application Priority Data

Jul. 27, 1979 [DE] Fed. Rep. of Germany ..... 2930474
Mar. 7, 1980 [DE] Fed. Rep. of Germany ..... 3008785

[51] Int. Cl.[3] ..... B65H 17/12; B65H 19/26
[52] U.S. Cl. ..... 242/56 R; 242/66
[58] Field of Search ..... 242/56 R, 66, 56.8, 242/56.6

[56] References Cited

U.S. PATENT DOCUMENTS

| | | | |
|---|---|---|---|
| 3,239,155 | 3/1966 | Kinoshita | 242/56 R X |
| 3,539,125 | 11/1970 | Patriksson | 242/56 R |
| 3,794,255 | 2/1974 | Harmon et al. | 242/56 R |
| 3,841,578 | 10/1974 | Dorfel | 242/66 |
| 3,869,095 | 3/1975 | Diltz | 242/56 R |
| 3,961,759 | 6/1976 | Fujiwara | 242/66 |
| 4,157,794 | 6/1979 | Brandauer et al. | 242/66 |

FOREIGN PATENT DOCUMENTS 2709684 9/1977 Fed. Rep. of Germany .

*Primary Examiner*—John M. Jillions
*Attorney, Agent, or Firm*—Ostrolenk, Faber, Gerb & Soffen

[57] ABSTRACT

A double-drum winder including means for changing winding cores is disclosed. Two support drums are separated by a first gap, through which a web is fed from below. A roll, comprising a winding core and part of the web wrapped around it, rests on both drums. The web follows the surface of the first drum through the first gap, to the point of contact between the first drum and the roll. At least one drum is driven, wrapping the web onto the roll. When the roll is complete, it is lifted and simultaneously moved toward the second drum, opening a second gap between the roll and the first drum. A holding device, which is preferably rotated into position about the second drum through the first gap, holds the web against the first drum. A severing device severs the web. The severing device preferably is rotated about the first drum through the second gap to effect the severing. Because the roll is lifted toward the second, rather than the first drum, the web is stretched between the roll and the point at which the web is held against the first drum, facilitating the severing of the web. A new winding core is then introduced, preferably through the second gap, and the end of the web being held against the first drum is attached to it.

18 Claims, 9 Drawing Figures

DOUBLE-DRUM WINDER

BACKGROUND OF THE INVENTION

The present invention relates to a double-drum winder for the winding of webs on winding cores. It particularly relates to roll cutting machines of the type in which a paper web is fed between two supporting drums for winding on a core which is located above the drums. The roll, as it forms, rests on the drums. Such machines typically have a device for lifting a fully wound roll from the first drum (the web being wrapped at least part way around one of the drums, herein referred to as the first drum), means for cutting the web, a device for holding the newly cut end of the web on the first drum and a device for inserting a new winding core.

Individual smaller rolls of a web are formed from large stock rolls by means of such drum winders. In cooperation with roll-cutting machines, the web withdrawn from a stock roll is cut in the longitudinal direction into individual narrower webs, which are wound by a winding device onto a plurality of winding cores which are located axially alongside of each other. When the wound roll in question has reached the desired diameter, it is removed from the winding device, the web which is still attached to the stock roll is cut, and the new web-end thus formed is attached to the newly inserted winding core.

For carrying out these various steps, there are known methods and apparatus by means of which the replacement of one winding core with another can be effected substantially automatically.

For example, German Offenlengungsschrift No. 27 09 684 discloses a method and a corresponding apparatus in which the completely wound roll is moved from a position in which it rests on both support drums to a second position on top of the first drum, about which the web is partially wrapped. The new winding core is then introduced through the gap produced thereby between the other supporting drum and the complete roll, and the web is fastened to the new winding core. At the same time, the web is cut between the new winding core and the complete roll. With this known apparatus, the finished roll must first of all be moved onto the wrapped support drum, i.e. in a direction opposite the direction in which it must later be conveyed. Only then, after the new winding core has been inserted, is the full roll again lowered and passed over the second support drum, which does not carry the web, onto a lowering table. The time required by the two movements in opposite directions of the complete roll is relatively large.

SUMMARY OF THE INVENTION

The object of the present invention is to create an apparatus of the above described type by means of which the replacement of a full roll with an empty winding core is faster than with the known apparatus and the time required to effect the change is substantially reduced.

According to the invention, a perforating ledge, which can be introduced through a gap which is defined between the first support drum and the complete roll when the latter is lifted, serves as a cutting device to sever the web. The web is perforated by the perforating ledge, and by further movement of the full roll in the direction of travel of the web, is completely separated at the point defined by the perforation. Satisfactory perforation in this connection requires only relatively few holes to be formed in the web, as could be produced by a few teeth on the perforating ledge.

In the apparatus of the invention, the full roll therefore need not be first pressed onto the first support drum, opposite the direction of travel of the web, and then brought back into its initial position and then conducted further in the direction of travel over the second support drum. The transport of the full roll and the introduction both of the cutting device and of a new winding core occur while the full roll is moved in the natural direction of travel of the web. As a result, the change can be effected much more rapidly than has hitherto been possible.

As a further development of the apparatus of the invention, the perforating ledge also serves to hold the web against the first drum. For this purpose the free end of the perforating ledge is preferably swingable about an axis parallel to and spaced from the axis of the drum.

In accordance with one very advantageous further development of the invention, in order to assure precise perforation of the web, there is provided an additional holding device which includes a mount which can be moved up through the gap between the two support drums. The holding device also includes a holding ledge. The holding ledge is pivotably attached to the upper part of the mount and can be applied against the first drum in its upper ascending quadrant. In this position, the holding ledge cooperates with the perforating ledge, which can be introduced through the gap between the first drum and the raised full roll. The edge of the holding ledge, which can be applied against the first drum, and the front edge of the perforating ledge are preferably developed with dentate edges so as to engage each other in such a manner that the teeth of the perforating ledge, upon engagement with the holding ledge, perforate the web which is present between the two ledges. The teeth of the holding ledge are preferably rounded so as to be blunt, while those of the perforating ledge are sharp. Such a holding device, which is passed from below between the drums, holds the web against the first drum, after which the perforating ledge is introduced, perforating the web by cooperating with the holding ledge. The perforating ledge, by swinging against the first drum, then takes over the task of holding the web against the first drum so that the holding ledge can be moved away again in order to make room for a new winding core which is to be inserted between the support drums.

In order to facilitate the parting of the web, to make the tear cleaner and to avoid too early a tearing, the holding ledge, in accordance with one further advantageous embodiment of the invention, has only a few teeth, which are arranged at a distance apart equal to a multiple of their root width and which engage corresponding notches in the perforating ledge which are arranged an equal distance apart. There may also be provided, between the gaps of the perforating ledge, a plurality of smaller teeth, which effect the final separating process. Therefore, upon introduction of the perforating ledge, the web is initially punctured only by the teeth of the holding ledge. As a result of this development, there is no danger of a premature tearing of the web. Only after the perforating ledge has fully penetrated the web of paper, which has been laid relatively loosely against the holding ledge, and engaged the holding ledge, and after the web has been pulled taut by the motion of the full roll away from the first support drum, is the complete and clean tear effected by the smaller teeth of the perforating ledge.

When the tear is complete and the web is held against the first drum by the perforating ledge, a new winding core can be introduced above the first drum. In a further development of the invention, there is employed for this purpose a trough which is parallel to the drum and which is fastened at its ends to swing levers which are supported on the mount of the perforating ledge. A clamping device which can be opened by fluid pressure may suitably serve in order to hold a winding core in the trough.

Other objects and features of the invention will be apparent from the following description and the accompanying drawings.

DETAILED DESCRIPTION OF THE PREFERRED EMBODIMENTS

Figure 1:
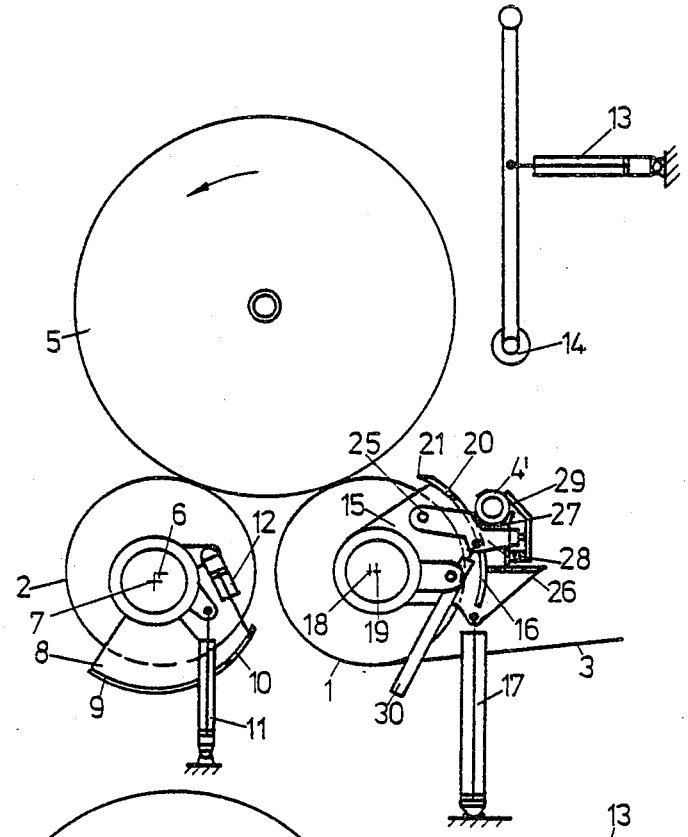
FIGS. 1 through 3 are diagrams showing the basic successive steps of a change of the roll in the case of a double-drum winder in accordance with the invention.
Figure 4:
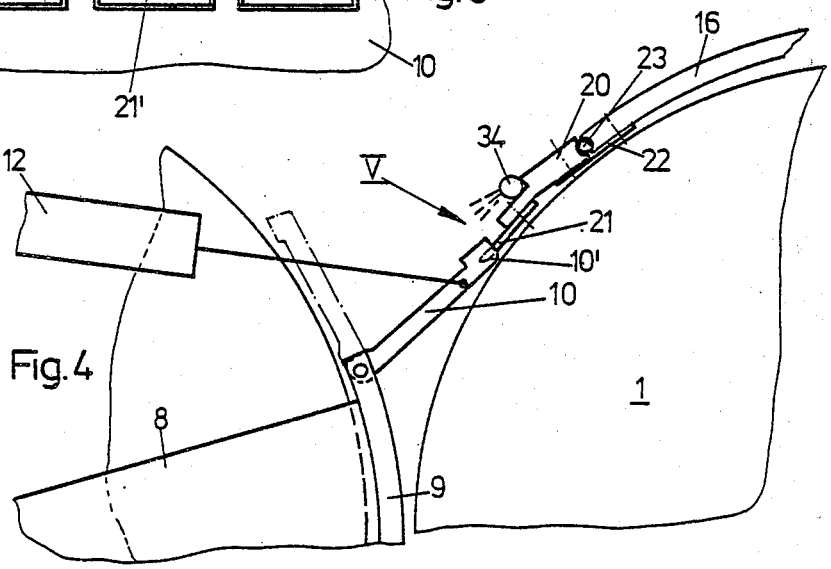
FIG. 4 shows, on a larger scale, the holding ledge and the perforating ledge in the position shown in FIG. 2.

FIG. 1 shows a double-drum winder after the completion of the winding. At least one of the two drums 1 and 2 is driven by conventional drive 1*a*. The web 3, which is fed between the drums, is wrapped around the first drum 1. The roll 5, which has been fully wound on a winding core 4, rests on both the drums 1 and 2. A guard 8 is disposed at each end of the drum 2 and is swingable about an axis 7 parallel to and spaced from the axis 6 of the drum 2. Axis 7 passes through drum 2. A shell segment 9 is fastened between the guards 8. Guards 8 and shell segment 9 form a mount for a holding ledge 10, which is pivotably connected to the shell segment 9 along the edge of the latter facing the gap between the two drums 1 and 2. By means of a pressure-fluid drive 11, the guards 8 together with shell segment 9 and holding ledge 10 can be swung about axis 7 out of the position shown in FIG. 1 into the position shown in FIG. 2 and back again. The holding ledge 10 can also be pivoted with respect to the shell segment 9 by means of another pressure-fluid drive 12 in such a manner that it is pressed against the web 3 on drum 1 (FIG. 2; also shown in greater detail in FIG. 4).

A second shell segment 16 is mounted between two guards 15 which are disposed at either end of drum 1. Shell segment 16 and guards 15 are rotatable, by means of a pressure-fluid drive 17, relative to drum 1 about an axis 19 which is parallel to but slightly spaced from the axis 18 of the drum 1. On the front edge of the shell segment 16, a ledge 20 having a perforating ledge 21 screwed on it (FIG. 4) is swingably fastened by means of a spring band 22. While the web 3 is held against the drum 1 by means of the holding ledge 10, the full roll 5 is moved by the ejector roller 14, actuated by a pressure-fluid drive 13, onto the drum 2 until the axis of the winder core 4 of the full roll 5 is almost directly above the axis 7 of drum 2. The shell segment 16 and perforating ledge 21 are then swung into the gap produced in this way between the roll 5 and the drum 1. Due to the eccentric arrangement both of the swingable mount 8, 9 for the holding ledge 10 and of the swingable mount 15, 16 for the perforating ledge 21, the respective distances between the holding ledge 10 and perforating ledge 21 and the corresponding part of the surfaces of drums 1 and 2 is greater in the position of rest (FIG. 1) than in the operating position (FIG. 2), where in each case the smallest possible distance is desired. The greater distances apart in the position of rest assure better accessibility into the spaces between these parts and the corresponding drum surfaces.

Figure 2:
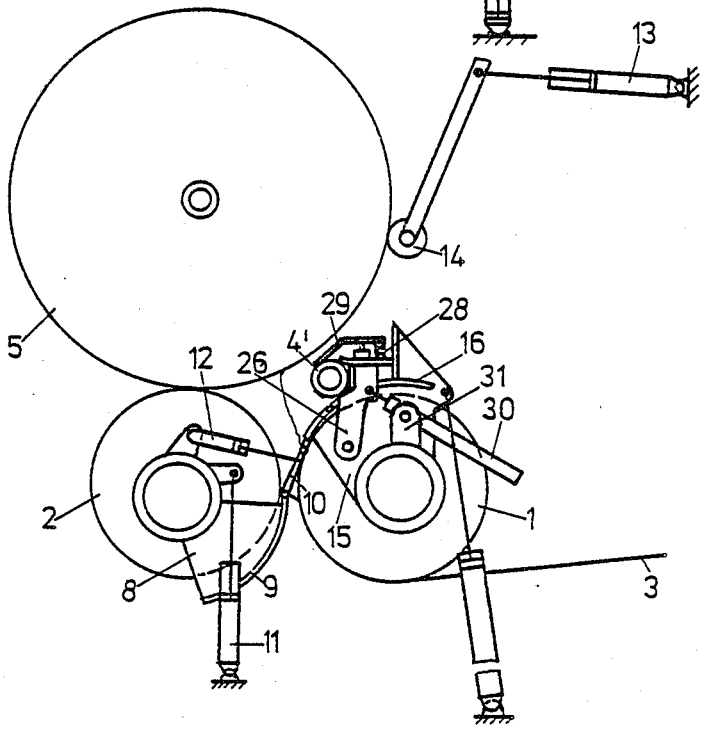
Figure 3:
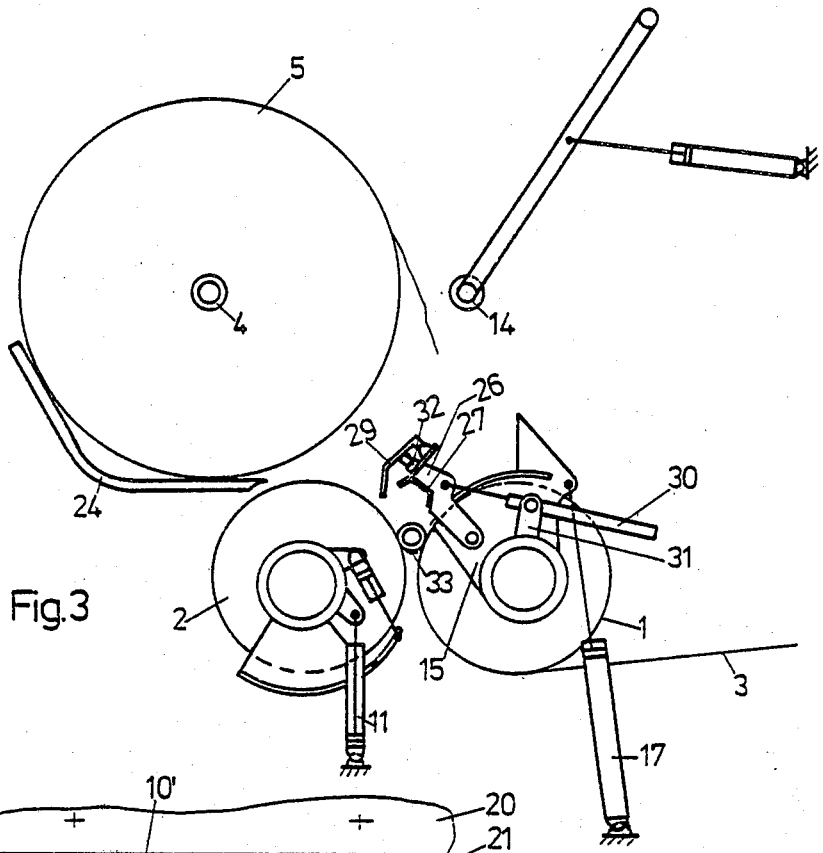
Figure 5:
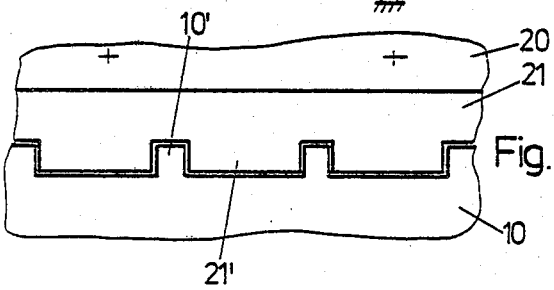
FIG. 5 is a view in the direction V indicated in FIG. 4.

The perforating ledge 21 and the holding ledge 10 are formed with interlocking teeth at their front edges, as shown in FIG. 5, so that they engage each other when they are in the closed position shown in FIG. 2. After the web 3 has passed between the two ledges and applies itself against the rounded protruding edges 10' of the holding ledge 10, it is perforated by the sharp edges 21' of the perforating ledge 21. After the perforation of web 3 by ledge 21, the full roll 5 is conveyed by the ejector roller 14 over the vertex of the drum 2 onto a delivery table 24 or the like, as shown in FIG. 3. This movement of the full roll 5 pulls the web 3 taut, causing the web 3 to tear completely at the perforation.

A hose 23 is supported in a groove defined between the facing, concavely hollowed edges of the shell segment 16 and the ledge 20. At the same time as the web 3 is torn as a result of the movement of the full roll 5, the perforating ledge 20 is pressed against the drum 1 by the action of pressure in the hose 23, holding the web 3 against the drum 1, so that the holding ledge 10 can be swung away from the drum 1 back into the position shown in FIG. 1.

On the guards 15 there are swingably supported, at 25, levers 26 which bear between them a trough-shaped receiver 27 holding a new winding core 4'. The new winding core 4' is clamped in place in trough 27 by means of the weight of a ledge 29 which is pivotably connected by means of lugs 28 to the levers 26. A pressure-fluid drive 30 is articulately mounted on a lug 31 on the guards 15 (FIG. 3). The pressure-fluid drive 30 swings the levers 26 and the receiving trough 27 with the new winding core 4' relative to the guards 15 until the receiving trough 27 containing the new winding core 4' is located above the gap between the two drums 1 and 2. Then by means of a pneumatic drive 32, the ledge 29 is raised and the new winding core 4' is dropped onto the drums 1 and 2.

When a winding core 4' is inserted into the receiving trough 27 from one end (i.e. in a direction perpendicular to the plane of FIG. 3), it is moved past a known dispenser (not shown) for double-backed adhesive tape which applies a length of such tape 33 to the side of the winding core 4' which will face downward in the gap between the drums 1 and 2 when the core 4' has been placed in contact with drums 1 and 2 in the manner described above. After the new winding core 4' has been placed on the support drums 1 and 2, the perforating ledge 21 is raised from the web 3 by means of releasing the pressure in the hose 23, the web 3 now being held clamped in place by the weight of the new winding core 4'. A new winding process now begins. The web 3 is immediately held fast by the adhesive tape 33 on the winding core 4'. On the top of the ledge 20 which holds the perforating ledge 21 there is fastened a blast pipe 34 which, when the winding is begun, blows against the winding core 4' to prevent the loosening of the web 3 from the core 4' and a concommitant bulging of the web over the devices which are still in their inward-swung (operating) position. After the first revolutions of the new winding core 4', the guards 15, the perforating ledge 21 and the receiving trough 27 are swung back into the position shown in FIG. 1.

Figure 6:
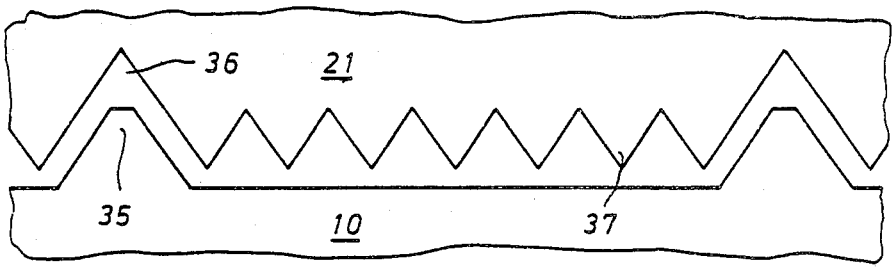
FIG. 6 is a view of an alternative embodiment of the perforation ledge and of the holding ledge.

An alternative embodiment is shown in FIG. 6. In this embodiment, the holding ledge 10 has teeth 35 which are arranged a distance apart that is equal to a multiple of their root width d and which are shaped as truncated triangles. The teeth 35 cooperate with corresponding notches 36 arranged the same distance apart in the perforating ledge 21. Between the notches 36, the perforating ledge 21 also has a large number of smaller teeth 37.

Figure 7:
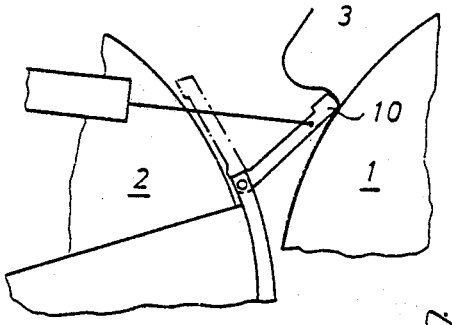
FIGS. 7 through 9 show diagrammatically various steps for tearing the web while changing a roll, which steps employ a perforating ledge and holding ledge in accordance with FIG. 6.
Figure 8:
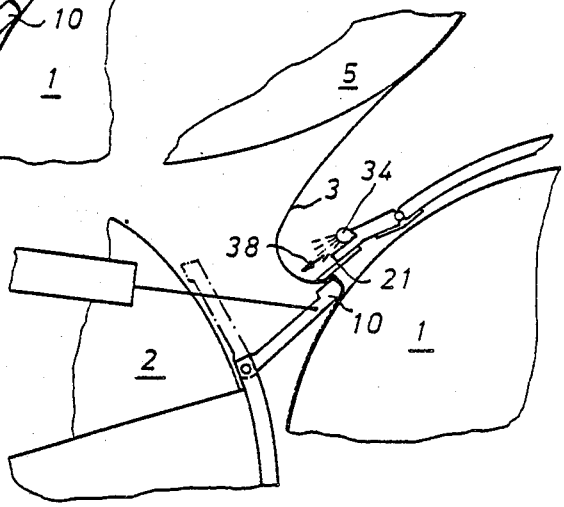
Figure 9:
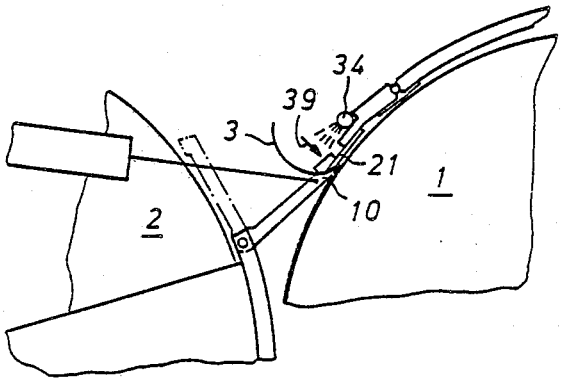

After the introduction of the holding ledge 10, it is pressed, as shown in FIG. 7, against the drum 1 and thereby holds the web 3 firmly against the surface of the drum 1. When the fully wound roll 5 is pushed up onto the drum 2, the web 3 is thereby loosened, so that upon the introduction of the perforated ledge 21 through the gap between the drum 1 and the roll 5 in the direction indicated by the arrow 38 (FIG. 8), the web 3 wraps itself around the front edge of the holding ledge 10. The blast pipe 34 (FIG. 8) aids in wrapping the web 3 around ledge 10. In this way, the web 3 is perforated by teeth 35 at points a larger distance apart than if the embodiment of FIG. 5 is used. In the next phase, shown in FIG. 9, the perforating ledge 21 swings into engagement with the teeth of the holding ledge 10, as indicated by arrow 39, in such manner that, with simultaneous tautening of the web as a result of the movement of the full roll 5 over the top of the drum 2, complete perforation is effected by the teeth 37 of the perforating ledge 21, and the web 3 is severed.

Although the present invention has been described in connection with the preferred embodiments thereof, many variations and modifications will now become apparent to those skilled in the art. It is preferred, therefore, that the present invention be limited not by the specific disclosure herein, but only by the appended claims.

What is claimed is:

1. A double-drum winder for winding a web in a roll on a winding core, comprising:

first and second support drums having parallel axes, each of said support drums being rotatable about its respective axis; said support drums being disposed side-by-side and defining a first gap between them; said support drums adapted to support a roll that comprises a winding core and a web wrapped around the winding core, said support drums being adapted to support the roll in such a manner that when the roll is placed on said support drums with a portion of the web extending through said first gap and said drums rotate, the portion of said web extending through said first gap is wound onto the roll;

means for rotating at least one of said support drums in a direction such that the web moves through said first gap and then through a second gap defined between the first of said drums and the roll and is then wound onto the roll;

means for raising the roll off said first support drum after the roll has been placed on said first support drum and after the web has been wound on the roll, said raising means displacing the roll generally away from said first support drum and generally toward the second of said drums, whereby raising the roll enlarges said second gap;

a holding ledge movable into said first gap for engaging the web on the side thereof facing toward said second drum for pressing the web against said first drum;

severing means movable into said second gap for engaging the web on the side thereof facing toward said first drum and for engaging said holding ledge and for severing the web between said severing means and said holding ledge.

2. The double-drum winder of claim 1, wherein said severing means includes a ledge for pressing the cut end of the web against said first drum after the web has been severed and after said holding ledge has been moved out of said first gap.

3. The double-drum winder of claim 1, further comprising means for positioning a second winding core for attachment thereto of the cut end of the web which has been separated from the roll by said severing means, for winding the separated web onto the second winding core.

4. The double-drum winder of claim 3, wherein said positioning means comprises a trough having an open side parallel to said axis of said first support drum for holding a new winding core for introducing it into said first gap;

said trough is secured to said perforating ledge mount by means of swing levers in such manner as to be rotatable relative to said perforating ledge mount.

5. The double-drum winder of claim 3, wherein said positioning means comprises means for inserting a new winding core into said first gap.

6. The double-drum winder of claim 5, wherein said positioning means further comprises a trough having an open side parallel to said axis of said first support drum for holding the new winding core for introducing it to said first gap.

7. The double-drum winder of claim 6, wherein said positioning means further comprises a clamping device for holding the new winding core in said trough and for releasing it at a predetermined location relative to said support drums.

8. The double-drum winder of claim 1, wherein said severing means comprises a perforating ledge.

9. The double-drum winder of claim 8, wherein said perforating ledge and said holding ledge have dentate edges that engage each other when said holding ledge is holding the web against said first support drum and said perforating ledge is severing the web.

10. The double-drum winder of claim 9, wherein the teeth of said dentate edges are rectangular.

11. The double-drum winder of claim 9, wherein the teeth of said dentate edges are generally triangular.

12. The double-drum winder of claim 11, wherein said dentate edge of said holding ledge has two teeth having the shape of truncated triangles and said dentate edge of said perforating ledge has two notches corresponding to said two teeth and cooperating with said two teeth when said edges engage each other; said dentate edge of said perforating ledge further having a plurality of teeth which are shorter than said two teeth of said holding ledge and which are disposed between said two notches; said shorter teeth being for effecting the final severing of the web.

13. The double-drum winder of any one of claims 10, 11 or 12, wherein said teeth of said holding ledge are relatively blunt and said teeth of said perforating ledge are sharp.

14. The double-drum winder of claim 8, further including means for introducing said perforating ledge through said second gap, said means for introducing including a perforating ledge mount adapted for rotational motion about a third axis parallel to the axis of said first support drum.

15. The double-drum winder of claim 14, wherein said third axis about which said perforating ledge rotates passes through said first support drum and wherein said perforating ledge mount is pivotally secured to said first support drum.

16. The double-drum winder of claim 14, wherein said perforating ledge is connected with said perforating ledge mount by means of a spring band and wherein said means for introducing said perforating ledge through said second gap further comprises an expandable hose which is arranged between said perforating ledge and said perforating ledge mount for controlling the angle between said perforating ledge and the surface of said first support drum by means of varying the pressure within said hose.

17. The double-drum winder of claim 14, further including means for introducing said holding ledge through said first gap and including a holding ledge mount that is rotationally movable about a fourth axis which is parallel to said axis of said second support drum.

18. The double-drum winder of claim 17, wherein said fourth axis passes through said second support drum and said holding ledge mount is pivotally secured to said second support drum.

* * * * *